United States Patent [19]

Chase

[11] 4,138,830

[45] Feb. 13, 1979

[54] SNOW THROWER WITH COMBINED DISCHARGE VANE SUPPORT AND STRIKE-OFF WALL

[75] Inventor: Alan L. Chase, Oostburg, Wis.

[73] Assignee: Allis-Chalmers Corporation, Milwaukee, Wis.

[21] Appl. No.: 881,003

[22] Filed: Feb. 24, 1978

[51] Int. Cl.[2] ..... E01H 5/00

[52] U.S. Cl. ..... 37/43 D; 193/2 A

[58] Field of Search ..... 37/43 R–43 W, 37/20–27; 193/2 R, 2 A, 28–30, 33–34

[56] References Cited

U.S. PATENT DOCUMENTS

| | | | |
|---|---|---|---|
| 3,359,661 | 12/1967 | Speiser et al. | 37/43 D |
| 3,452,460 | 7/1969 | Cope et al. | 37/43 D |

FOREIGN PATENT DOCUMENTS

| | | | |
|---|---|---|---|
| 845605 | 7/1956 | Canada | 37/43 R |
| 416726 | 12/1946 | Italy | 37/43 D |
| 123618 | 12/1948 | Sweden | 37/43 D |

*Primary Examiner*—E. H. Eickholt
*Attorney, Agent, or Firm*—Charles L. Schwab

[57] ABSTRACT

A compact, lightweight snow thrower having a power driven impeller rotating about a horizontal, transverse axis to throw snow upwardly and forwardly through a chute which is substantially coextensive in width with the axial length of the impeller. A plurality of laterally spaced upright vanes are disposed in and pivotally connected to the upper end of the chute for the purpose of directing the discharge of snow. The chute includes a front wall portion which serves as a support for the discharge directing vanes and as a strike-off wall preventing jamming of the discharge chute when the snow thrower encounters deep snow. Snow thrown by the impeller against the front wall portion tends to fall down because of its vertical disposition.

8 Claims, 4 Drawing Figures

17
57
68
67
66
65
64
63
62
61
168
167
166
165
164
163
162
161
III
III
53
21
20
51
15
18
23
22
56
19
16

SNOW THROWER WITH COMBINED DISCHARGE VANE SUPPORT AND STRIKE-OFF WALL

RELATED APPLICATIONS

Various features of the snow thrower disclosed herein are shown in my copending patent applications of even filing date entitled "Vane Adjusting Mechanism For a Powered Snow Thrower" and "Snow Discharge Vane Arrangement for a Powered Snow Thrower."

TECHNICAL FIELD OF THE INVENTION

This invention relates to a walk-behind snow thrower of the type having a powered impeller which rotates about a horizontal transverse axis to throw snow upwardly and forwardly through a discharge chute.

BACKGROUND OF THE INVENTION

Lightweight snow throwers of a type using a powered impeller disposed on a transverse horizontal axis and an upwardly and forwardly directed discharge chute with directional vanes are shown in U.S. Design Pat. Nos. 241,762; 205,531; 209,305 and 208,199; in U.S. Pat. Nos. 3,359,661 and 3,452,460; and Norwegian Pat. No. 74,014. Vehicular mounted snow throwers having vanes for directing the discharge of snow are shown in U.S. Pat. Nos. 1,724,692; 2,498,522 and 2,706,864.

SUMMARY OF THE INVENTION

The invention is embodied in a snow thrower of the type including a powered impeller at the front thereof rotatable about a horizontal transverse axis, a discharge chute coextensive with and disposed above the impeller and discharge directing vanes in the discharge chute for directing snow thrown therethrough by the impeller and is characterized by the provision of walls defining a housing including laterally spaced sidewalls, the lower portions of which support the impeller and upper ends of which form the sidewall portions of the chute, a rear wall curving upwardly from a scraper edge and having an upper portion forming the rear wall of the chute and a front wall portion extending substantially vertically when the snow thrower is in its normal working position and a plurality of laterally spaced upright vanes having their upper front and upper rear parts pivotally connected to the upper portions of the upper portions of the front and rear walls of the discharge chute.

The upper ends of the vanes may be substantially coterminous with the top of the chute.

One of the problems concerning lightweight snow throwers using a transverse impeller and a coextensive forwardly open discharge chute is that the discharged snow is dispersed forwardly over a wider area than is desired. Also, a forwardly open discharge chute can be clogged by pushing the snow thrower forwardly into deep snow. The front wall portion of the chute provided by the present invention provides improved directional control of discharged snow and protects against clogging of the chute when the snow thrower encounters deep snow.

BRIEF DESCRIPTION OF THE DRAWINGS

One embodiment of the invention is illustrated in the drawings in which.

DETAILED DESCRIPTION OF THE INVENTION

Figure 1:
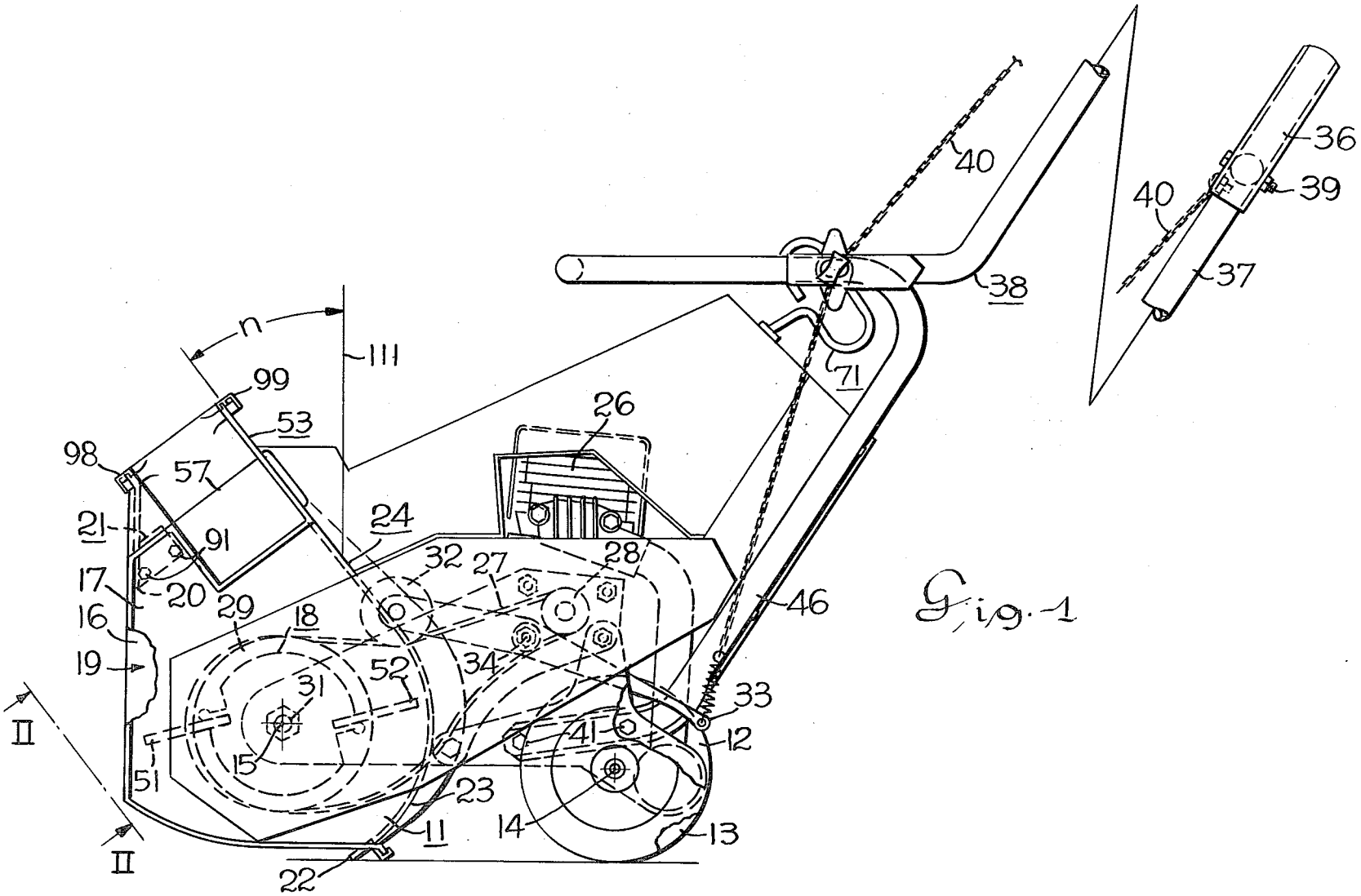
FIG. 1 is a left side view of the lightweight snow thrower incorporating the present invention.
Figure 2:
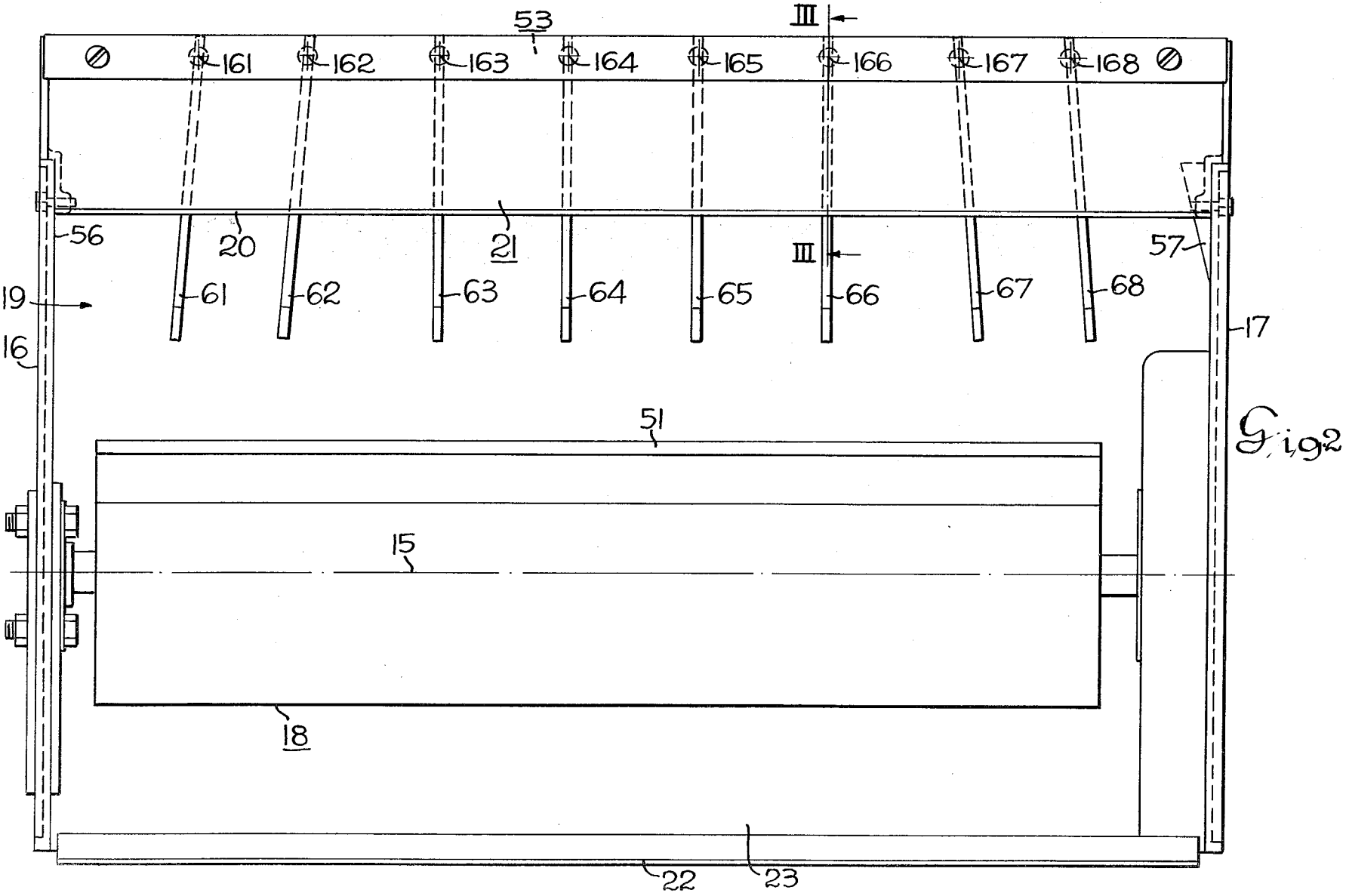
FIG. 2 is a view taken along the line II—II in FIG. 1.

As illustrated in FIGS. 1 and 2, the lightweight snow thrower of the present invention includes a housing 11 which is supported on a pair of laterally spaced wheels 12, 13 mounted for rotation about a transverse axis 14. The housing 11 includes a pair of laterally spaced vertical sidewalls 16, 17, the lower portions of which support a shaft 31 of an impeller 18 by suitable bearings (not shown) for rotation about a horizontal transverse axis 15. A forwardly opening entryway 19 is provided for snow to enter the snow thrower as it is pushed forwardly by a walk-behind operator. The entryway 19 is formed by the vertical walls 16, 17, the lower edge 20 of a front wall portion 21 of a discharge chute 53 and a transverse scraper edge 22 at the bottom end of a lower curved part 23 of a rear wall 24. The impeller 18 is driven by a small, air cooled, internal combustion engine 26 through a drive train which includes a V-belt 27 cooperably engaging the engine drive pulley 28 and a driven V-belt pulley 29 secured to the shaft 31 of the impeller 18. The drive belt 27 is selectively tightened by a clutching idler pulley 32 which is rotatably mounted on a clutch lever 33. The clutch lever 33 is pivotally mounted on the housing by a pin 34 and is selectively operated by a manual control handle 36 pivotally mounted on the upper part 37 of a two-piece handle 38 by a bolt 39. The lever 36 is connected to the rear end of the clutch lever 33 by a suitable flexible control member such as the illustrated chain 40. The lower part 46 of the handle 38 is secured at its lower end by cap screws 41 to the housing 11.

Figure 3:
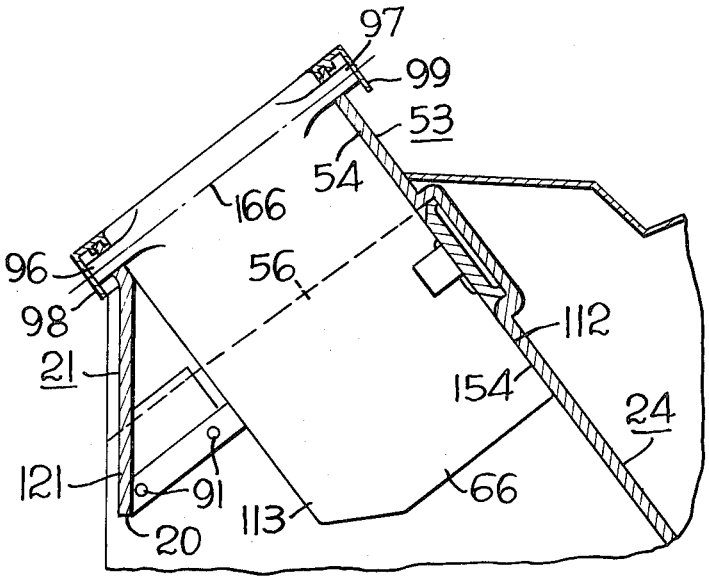
FIG. 3 is a section view taken along the line III—III in FIG. 2.
Figure 4:
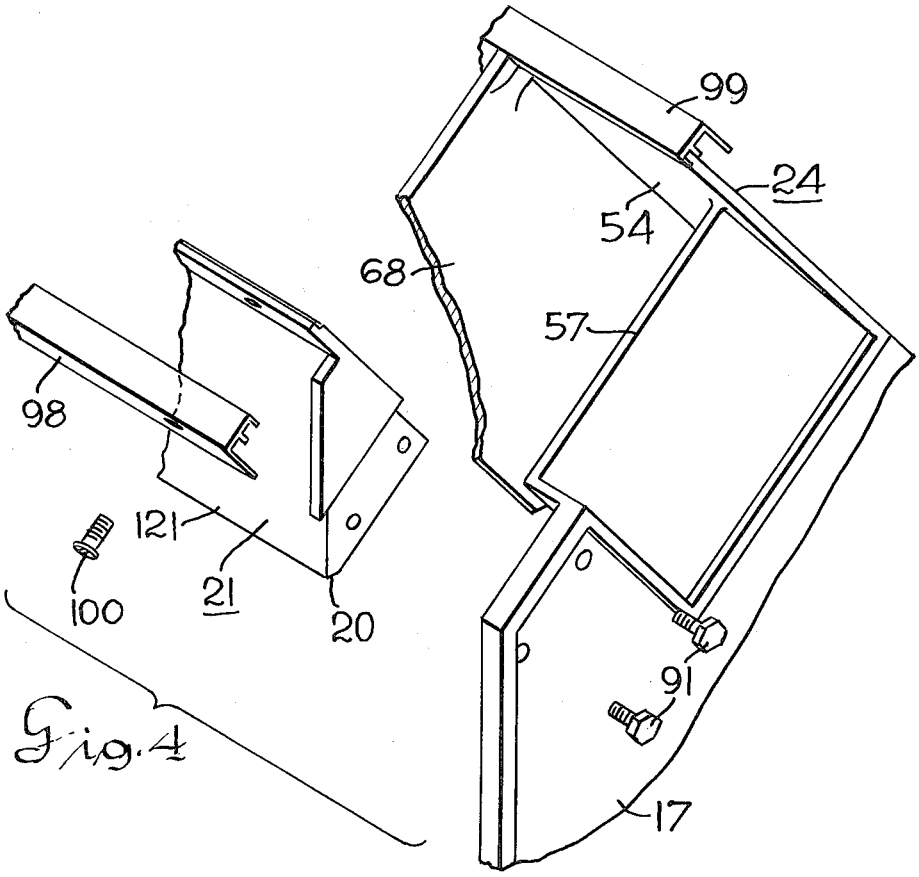
FIG. 4 is an exploded isometric view showing part of the removable front wall portion of the discharge chute.

The impeller 18 is rotated in a counterclockwise direction as viewed in FIG. 1 and the two transverse rubber-like paddles 51, 52 throw the snow upwardly through the forwardly and upwardly disposed discharge chute 53 disposed above the impeller. Referring also to FIGS. 3 and 4, the chute is defined by a flat upper wall portion 54 of the rear wall 24, the front wall portion 21 and a pair of sidewall portions 56, 57 which are, in effect, continuations of the laterally spaced sidewalls 16 and 17, respectively. The discharge chute 53 is substantially coextensive with the axial length of the impeller 18. The discharge of snow from the chute 53 is controlled by a plurality of upright, horizontally oriented vanes 61-68, the upper ends of which are approximately coterminous with the upper ends of the front and rear walls 21, 54 of the chute 53. In order to permit lateral tilting adjustment of the vanes 61-68, the upper ends thereof are pivotally connected to the upper ends of the front and rear walls 21, 54 of the chute 53 on a plurality of parallel, laterally spaced axes 161-168.

A manually operated vane adjusting mechanism 71 is provided to selectively adjust the vanes for straight ahead or lateral discharge of snow. This adjusting mechanism is more fully described in my copending U.S. patent application of even date entitled "Vane Adjusting Mechanism for a Powered Snow Thrower."

As shown in the drawings, particularly in FIGS. 3 and 4, the front wall portion 21 of the chute 53 is releasably secured at its laterally opposite ends to the side walls 16, 17 by releasable fastening means in the form of cap screws 91. The front wall portion 21 not only serves to pivotally support the upper ends of the vanes but also serves as a strike-off wall when operating in deep snow. As shown in FIG. 3, the vane 66 has trunnions 96, 97 aligned on axis 166 which pivotally fit in suitable recesses or slots in the top of front and rear wall portions 21, 54. Since the vanes 61-68 are of identical construction, the mounting of the other vanes is identical to that of vane 66. Extruded angle sections 98, 99 are secured to the top of the wall portions by suitable cap screws 100 and present parts in downwardly confronting relation to the trunnions on the vanes 61-68 thereby preventing upward removal of the vanes.

The chute 53 is inclined forwardly from the vertical plane 111 at an angle n of approximately 37 degrees and the front and rear edges of the vanes are disposed at the same angle to the vertical, when the snow thrower is in its normal operating or working position, as shown in FIG. 1. As shown in FIG. 3, the rear edge 112 of vane 66 is adjacent and parallel to the front surface 154 of wall portion 54 and the front edge 113 of vane 66 is parallel to rear edge 112. As shown in FIG. 3, the lower edge 20 of the front wall portion 21 is disposed above the front of the impeller, is at a height substantially equal to the height of the top of the impeller and is disposed forwardly to the lower front edge of the vanes. The front edges of the vanes diverge from the front wall portion in the downward direction from their pivot connection with the front wall portion.

OPERATION AND USE OF THE INVENTION

When the walk-behind operator pushes the snow thrower into a deep deposit of snow, the strike-off wall in the form of front wall portion 21 will prevent the deep snow from being shoved directly into the chute as occurs in prior art snow throwers having forwardly open chutes. Thus, the chute 53 will remain open to discharge snow even when working in deep snow. By forming the lower part 121 of the front wall portion 21 so that it is substantially vertical in the normal working position of the snow thrower, the snow thrown thereagainst by the impeller will tend to fall directly down. There is a markedly greater tendency for the chute to clog when the front wall is disposed adjacent to the front edge of the vanes. In the present invention, the snow thrown against the front wall portion has a greater tendency to fall therefrom because of its vertical disposition and because of its lower part being spaced forwardly from the vanes. In other words, the surface of the vanes is not available for the snow thrown against the front wall to cling to and it will have a greater tendency to drop. Also the snow will have a greater tendency to fall from a vertical surface than slide down a sloping surface. As before stated, the front wall portion also serves to support the vanes at its upper end thus giving excellent support to the vanes in all their positions of adjustment.

The embodiments of the invention in which an exclusive property or privilege is claimed are defined as follows:

1. In a snow thrower having a powered impeller at the front thereof rotatable about a horizontal transverse axis, a discharge chute coextensive with and disposed above the impeller and discharge directing vanes in the discharge chute for directing snow thrown therethrough by the impeller, the improvement characterized by wall means defining a housing including laterally spaced sidewalls, the lower portions of which support opposite ends of said impeller and the upper ends of which form the sidewall portions of said chute, a rear wall curving upwardly from a scraper edge and having an upper portion forming the rear wall portion of said chute and a front wall portion adjacent the front end of said sidewalls forming the front wall of said chute, said front wall portion extending substantially vertically when the snow thrower is in its normal working position, and a plurality of laterally spaced upright vanes having their upper front and upper rear parts pivotally connected to the upper portions of said front and rear walls.

2. The snow thrower of claim 1, wherein said front wall portion is disposed above the front of said impeller.

3. The snow thrower of claim 1, wherein the lower edge of said front wall portion is approximately at the same height as the top of said impeller.

4. The snow thrower of claim 1 wherein the lower edge cf said front wall portion is a substantial distance forwardly of the lower front edges of said vanes.

5. The snow thrower of claim 1 wherein said rear wall portion extends upwardly and forwardly at a predetermined angle to a transverse vertical plane and wherein the front and rear edges of said vanes slope at the same angle, said front edges of said vanes diverging from said front wall portion in a downward direction from their pivot connection therewith.

6. The snow thrower of claim 5 wherein said angle is at least 30 degrees when said snow thrower is in its normal operating position.

7. The snow thrower of claim 1 wherein the upper ends of said vanes are substantially coterminous with the upper end of said chute.

8. The snow thrower of claim 1 wherein said front wall portion is releasably secured to said sidewall portions.

* * * * *